US005865121A

United States Patent [19]

Testardi et al.

[11] Patent Number: 5,865,121

[45] Date of Patent: Feb. 2, 1999

[54] SYSTEM FOR CLEANING ROLLERS IN AN IMAGE FORMING DEVICE

[75] Inventors: Stephen L. Testardi, Boise; R. Scott Johnson, Nampa, both of Id.

[73] Assignee: Hewlett-Packard Company, Palo Alto, Calif.

[21] Appl. No.: 15,673

[22] Filed: Jan. 29, 1998

[51] Int. Cl.[6] ..... B41C 33/00

[52] U.S. Cl. ..... 101/483; 101/425; 399/327; 399/99

[58] Field of Search ..... 101/483, 425, 101/423; 399/327, 99, 98

[56] References Cited

U.S. PATENT DOCUMENTS

| | | | |
|---|---|---|---|
| 3,706,491 | 12/1972 | Furman et al. | 399/327 |
| 5,138,390 | 8/1992 | Miyabayashi et al. | 399/328 |
| 5,142,340 | 8/1992 | Farrell et al. | 355/283 |
| 5,227,844 | 7/1993 | Bhattacharjee et al. | 399/99 |
| 5,423,411 | 6/1995 | Kennett | 15/256.51 |

*Primary Examiner*—Edgar Burr
*Assistant Examiner*—Anthony H. Nguyen

[57] ABSTRACT

A system for automatically cleaning toner build-up on a roller, such as the fuser pressure roller in an electrophotographic printing device, using the duplexing capability of the device. One embodiment is a method for cleaning a roller in an image forming device. The method includes the steps of: feeding a sheet of print media into the simplex paper path; printing a cleaning pattern on one side of the sheet; routing the sheet through the duplex paper path to invert the sheet; and routing the inverted sheet back through the simplex paper path. When the image forming device includes a fuser, such as with a laser printer, a toner image cleaning pattern is applied to the paper or other sheet media, the toner is fused to the paper, the paper is then routed through a duplexer and back through the fuser. When the cleaning page is fed into the image forming device the second time, it goes through the device with the printed side down. As it passes through the fuser, the toner that makes up the cleaning pattern becomes tacky. The tacky toner cleans the pressure roller as the roller comes in contact with the printed side of the page.

15 Claims, 4 Drawing Sheets

SYSTEM FOR CLEANING ROLLERS IN AN IMAGE FORMING DEVICE

FIELD OF THE INVENTION

The invention relates generally to electrophotographic printing and, more particularly, to a system for automatically cleaning a roller, such as the fuser pressure roller in an electrophotographic printing device, using the duplexing capability of the device.

BACKGROUND OF THE INVENTION

Electrophotographic printing involves applying a uniform surface charge to a photoconductor and exposing the photoconductor to imaging light in select areas to define a latent electrostatic image on the photoconductor. The latent image is developed by depositing toner particles on the surface of the photoconductor. The toner adheres to the imaged areas of the photoconductor to form a developed image that is transferred to paper or another imaging media. The loose toner is then fused to the paper by passing the paper between a heated fuser roller that contacts the top of the paper and an opposing pressure roller that contacts the bottom of the paper. Over time, toner builds up on the pressure roller. Toner build-up on the pressure roller must be cleaned periodically to maintain good print quality.

In the past, cleaning pads were used to clean toner build-up on the pressure roller. Cleaning pads are oil impregnated pads or fabric webs that contact the heated fuser roller to wipe away residual toner before the toner has a chance to deposit on the pressure roller. Cleaning pads have been largely eliminated from laser printers and other electrophotographic printing devices for both ecological and usability reasons. Cleaning pads have to be replaced each time the print cartridge is replaced. Eliminating cleaning pad replacement made it easier to replace the print cartridge. Cleaning pads require additional manufacturing materials—plastic substrate, fabric pad and lubricating oil—that often end up in a landfill. Since the elimination of cleaning pads, the build-up of toner on the fuser pressure rollers has become more of a problem. Newer self cleaning fuser designs have attempted to minimize toner build-up, but periodic cleaning is sometimes still necessary to maintain good print quality. The adverse effects of toner build-up on the pressure roller have become an increasingly important problem in those parts of the world where paper with high calcium carbonate content is used.

One solution to toner build-up in modern printing devices is the use of a cleaning page. Presently, the user must generate the cleaning page from the printer's front panel or by printing an appropriate image from the host. The cleaning page typically includes a wide diagonal bar printed across the width of the page along with text instructing the user to place the cleaning page back in the paper tray upside down and print the page again. When the cleaning page is fed into the printer the second time, it goes through the printer with the printed side down. As it passes through the fuser, the toner that makes up the diagonal stripe becomes tacky. The tacky toner cleans the pressure roller as the roller comes in contact with the printed side of the page. This manual process is inconvenient at best, and customers, particularly in network environments, either do not know how to or do not want to go through the effort of generating and processing the cleaning page.

SUMMARY OF THE INVENTION

Accordingly, the present invention is directed to a system for automatically cleaning toner build-up on a roller, such as the fuser pressure roller in an electrophotographic printing device, using the duplexing capability of the device. "Roller" as used in this Specification and in the claims appended hereto includes any of the various rollers, film tubes and similar components used to move, press, shape, apply or otherwise process print media in an image forming device. One embodiment of the invention is a method for cleaning a roller in an image forming device. The method includes the steps of: feeding a sheet of print media into the simplex paper path; printing a cleaning pattern on one side of the sheet; routing the sheet through the duplex paper path to invert the sheet; and routing the inverted sheet back through the simplex paper path. When the image forming device includes a fuser, such as with a laser printer, a toner image cleaning pattern is applied to the paper or other sheet media, the toner is fused to the paper, the paper is then routed through a duplexer and back through the fuser. When the cleaning page is fed into the image forming device the second time, it goes through the device with the printed side down. As it passes through the fuser, the toner that makes up the cleaning pattern becomes tacky. The tacky toner cleans the pressure roller as the roller comes in contact with the printed side of the page. This cleaning cycle may be initiated from within the printer after a predetermined number of pages have been printed, or from a remote source such as a host computer or network print server.

Another embodiment of the invention is an image forming device that includes a print engine and a printer controller. The print engine includes a photoconductor, a fuser and a duplexer. The printer controller is operatively coupled to the print engine and includes a microprocessor and related programmable memory configured to transmit electronic data to the print engine to apply a toner image cleaning pattern to a sheet of print media, fuse the toner image to the sheet, route the sheet through a duplexer to invert the sheet, and route the inverted sheet back through the fuser.

DETAILED DESCRIPTION OF THE INVENTION

Figure 1:
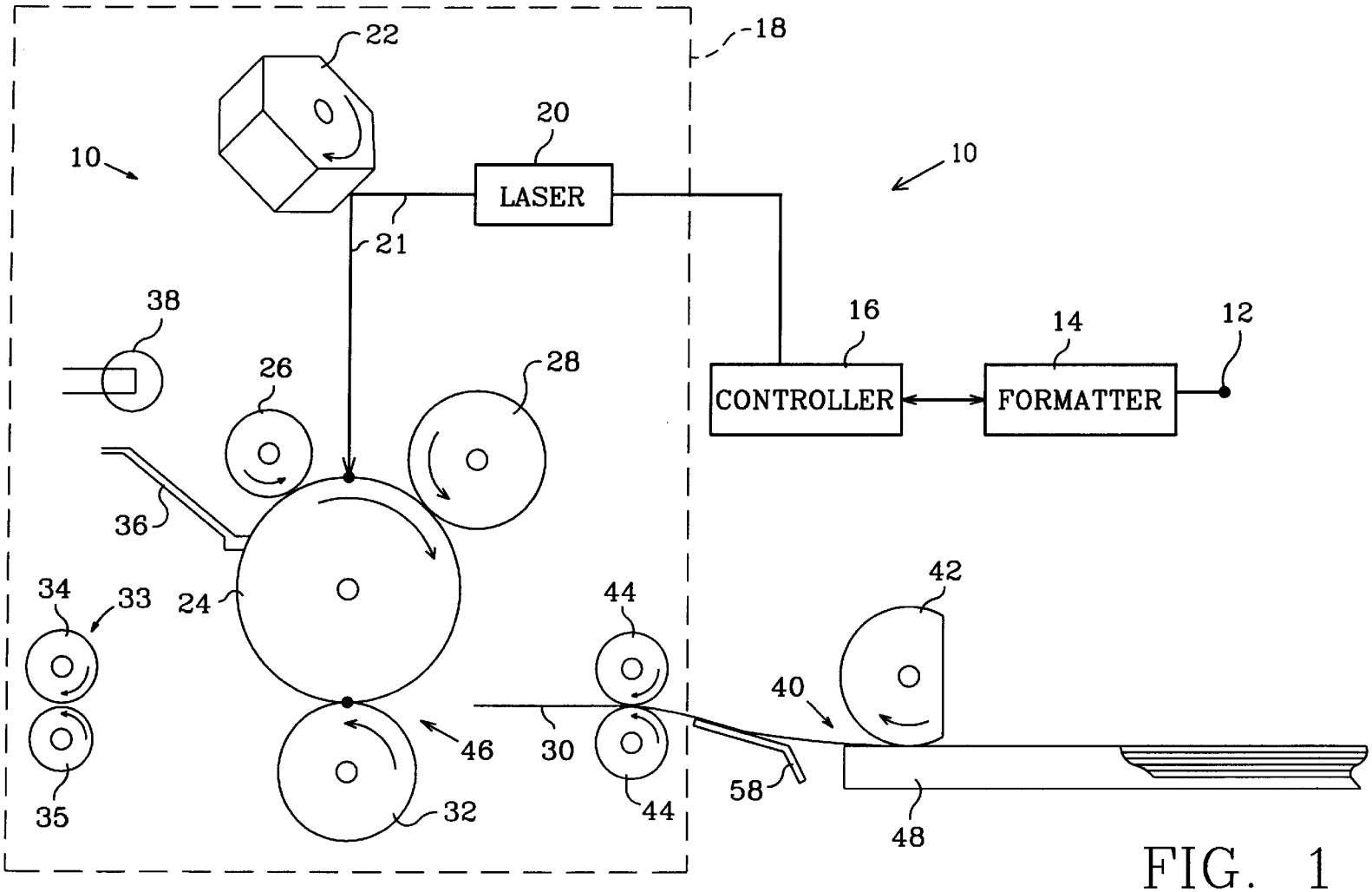
FIG. 1 is a schematic view of a laser printer illustrating the major components and operational characteristics of one type of image forming device into which the fuser cleaning system may be incorporated.
Figure 2:
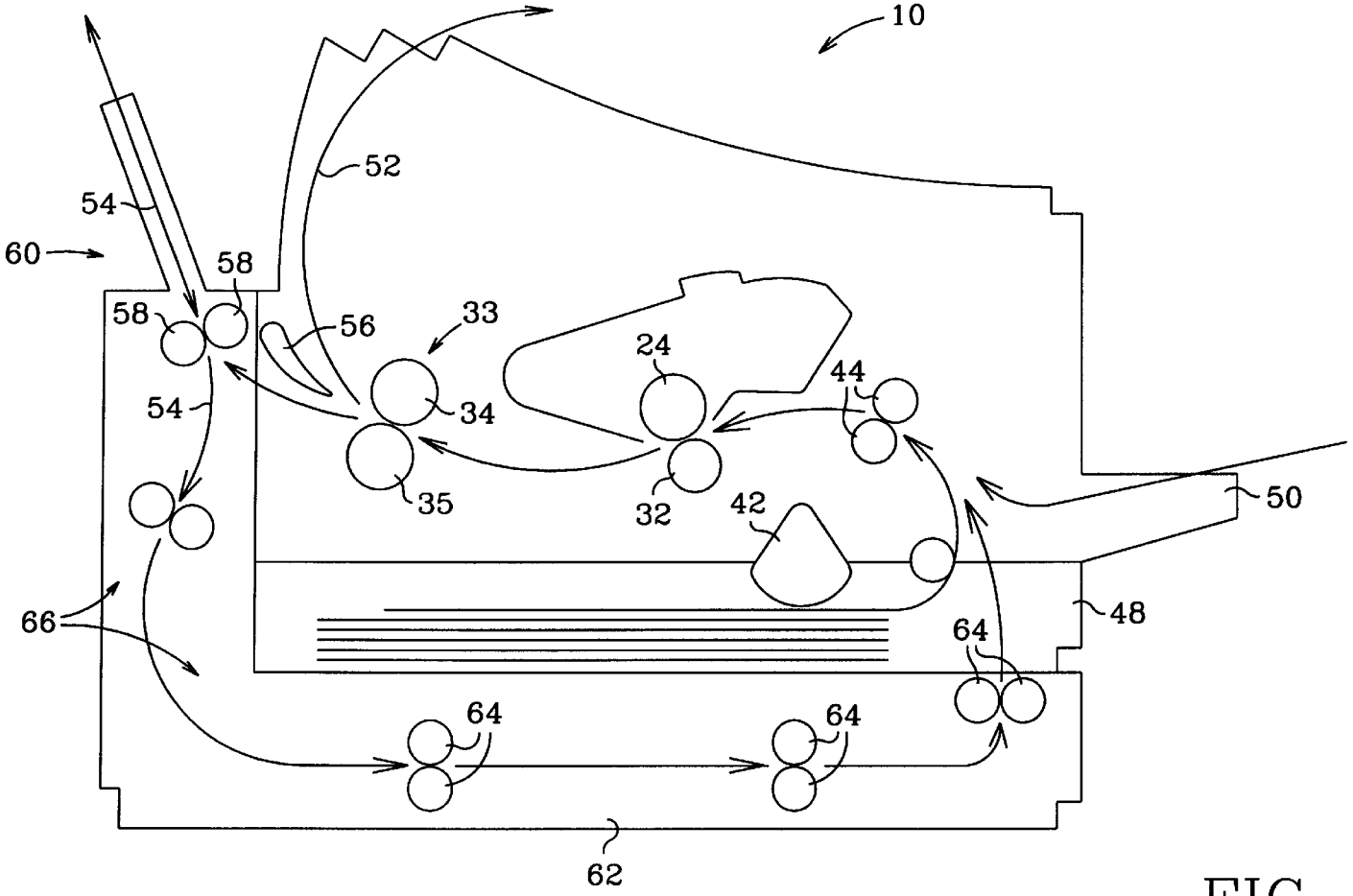
FIG. 2 is a schematic view of a laser printer such as the one illustrated in FIG. 1 showing the simplex and duplex paper paths.

FIG. 1 schematically depicts the basic components of a laser printer, designated by reference number 10, that may benefit from the cleaning system of the present invention. FIG. 2 shows the simplex and duplex paper paths in a duplex printer such as the Hewlett Packard Co. Model LaserJet 5 laser printer as one example of a printing device into which the invention may be incorporated. The cleaning system is well suited for use in a wide variety of duplexing electrophotographic printing devices, including printers, copiers and facsimile machines, and is not limited to the laser printer embodiment shown in the figures and described below. In addition, the system may be used to clean the fuser pressure roller and other rollers that can be cleaned by passing a toner image over the roller. In as much as the art of electrophotographic laser printing is well known, the basic components of laser printer 10 are shown schematically and their operation described only briefly.

In general, and referring to FIG. 1, a computer transmits data representing a print image to input port 12 of printer 10. This data is analyzed in formatter 14, which typically consists of a microprocessor and related programmable memory and page buffer. Formatter 14 formulates and stores an electronic representation of each page to be printed. Once a page has been formatted, it is transmitted to the page buffer. The page buffer breaks the electronic page into a series of lines or "strips" one dot wide. This strip of data is then sent to a printer controller 16. Controller 16, which also includes a microprocessor and related programmable memory, directs and manages the operations of print engine 18. Each strip of data is used to modulate the light beam produced by laser 20 such that the beam of light "carries" the data. The light beam is reflected off a multifaceted spinning mirror 22. As each facet of mirror 22 spins through the light beam, if reflects or "scans" the beam across the surface of a photoconductive drum 24. Photoconductive drum 24 rotates about a motordriven shaft such that it advances just enough that each successive scan of the light beam is recorded on drum 24 immediately after the previous scan. In this manner, each strip of data from the page buffer is recorded on photoconductive drum 24 as a line one after the other to reproduce the page on the drum.

Charging roller 26 charges photoconductive drum 24 to a relatively high substantially uniform negative (or positive) polarity at its surface. For discharge area development, such as that used in laser printers, the areas on the fully charged drum 24 exposed to light beam 21 from laser 20 represent the desired print image. The exposed areas of drum 24 are partially or fully discharged, depending on the intensity of light beam 21 and the duration of exposure. The unexposed background areas of drum 24 remain fully charged. This process creates a latent electrostatic image on conductive drum 24. Toner is electrostatically transferred from developing roller 28 toner onto photoconductive drum 24 according to the data previously recorded on the drum. The toner is thereafter transferred from photoconductive drum 24 onto paper 30 as paper 30 passes between drum 24 and transfer roller 32. The toner is fused to the paper as the paper passes between a heated fuser roller 34 that contacts the top of the paper and an opposing pressure roller 35 that contacts the bottom of the paper. Fuser roller 34 and pressure roller 35 are referred to jointly as fuser 33. Drum 24 is cleaned of excess toner with cleaning blade 36, completely discharged by discharge lamps 38 and then recharged by charging roller 26.

Referring now to FIGS. 1 and 2, each sheet of paper 30 is initially pulled into the pick/feed area 40 by feed roller 42 from a paper tray 48 or paper 30 is fed manually from a manual tray 50. The arrows in FIG. 2 show the route that a sheet of paper travels through both the simplex paper path 52, which feeds from paper, trays 48 and 50 and includes the print engine components, and the duplex paper path 54. As the leading edge of paper 30 moves through pick/feed area 40, it is engaged between a pair of registration rollers 44. Registration rollers 44 advance paper 30 fully into image area 46 until it is engaged between drum 24 and transfer roller 32 and toner is applied as described above. Paper 30 then moves through fuser 33. If duplex printing is selected, paper 30 is diverted from the normal simplex output path 52 to the duplex paper path 54 by duplexing guide 56. A pair of reversing rollers 58 move paper 30 through the switchback assembly 60. As the trailing edge of paper 30 passes duplexing guide 56, rollers 58 are reversed and paper 30 is directed to a holding tray 62. Holding tray 62 holds the paper that has been printed on one side while the print engine 18 prepares to print the second side. Rollers 64 move paper 30 back to registration rollers 44 and through the print cycle described above for printing on the second side.

Figure 4:
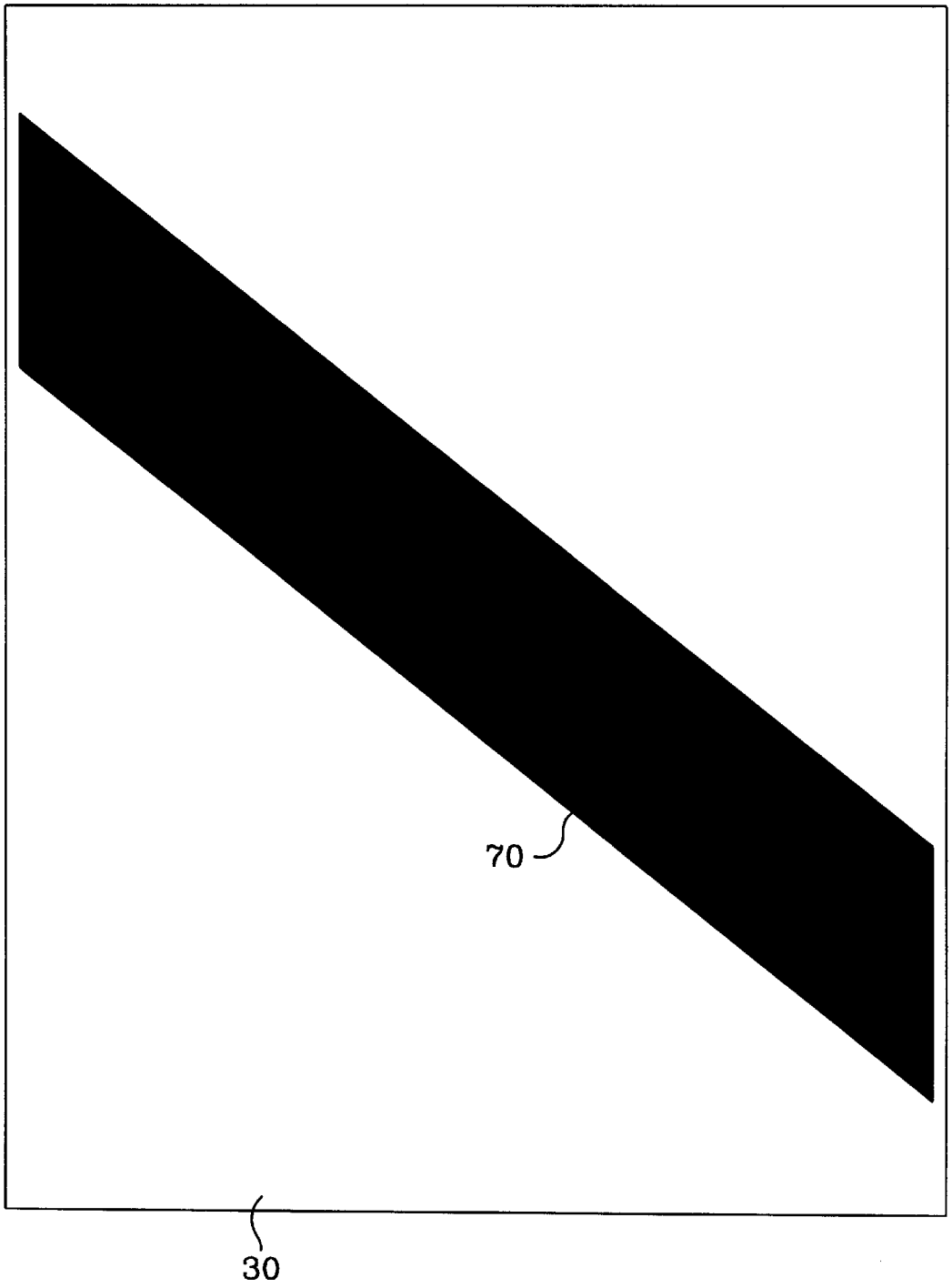
FIG. 4 is a plan view of a sheet of paper showing a cleaning pattern that extend across substantially the entire width of the sheet.

A cleaning page processed through duplexer 66 is used to clean pressure roller 35 in fuser 33. The cleaning page, which is also designated by reference number 30, consists of a wide diagonal bar or other suitable cleaning pattern 70 printed across the full width of the front/first side of paper 30 as shown in FIG. 4. After cleaning page 30 passes through duplexer 66, the diagonal bar is on the back side of page 30 as the page 30 passes through fuser 33 in the second print cycle. As cleaning page 30 passes through fuser 33, the toner that makes up the diagonal bar becomes tacky. The tacky toner cleans any toner build-up on pressure roller 35 as page 30 moves through the fuser. As an aid to the user, cleaning page 30 may be printed with text instructing the user that the cleaning process is complete and to discard the cleaning page.

The invention may be implemented through application software such as a printer life enhancement utility, through printer driver software with a cleaning page launching feature, through the formatter 14 or printer controller 16 firmware, or through a combination of these elements. For example, conventional printer controller firmware could be modified to detect if a duplexer is present and, if so, automatically process the cleaning page after it is printed. The firmware could also be modified to include a cleaning page cycle that automatically prints and processes a cleaning page at the first print job boundary after a predetermined or user selected number of pages have been printed. The cleaning page process could also be initiated by the user from the printer control panel. The invention may be readily implemented in existing printers by substituting a modified read only memory (ROM) for the existing ROM in which the firmware resides in either of the formatter 14 or printer controller 16. The front panel menu structure now used on some printers could then be changed to eliminate the "Process Cleaning Page" selection.

Figure 3:
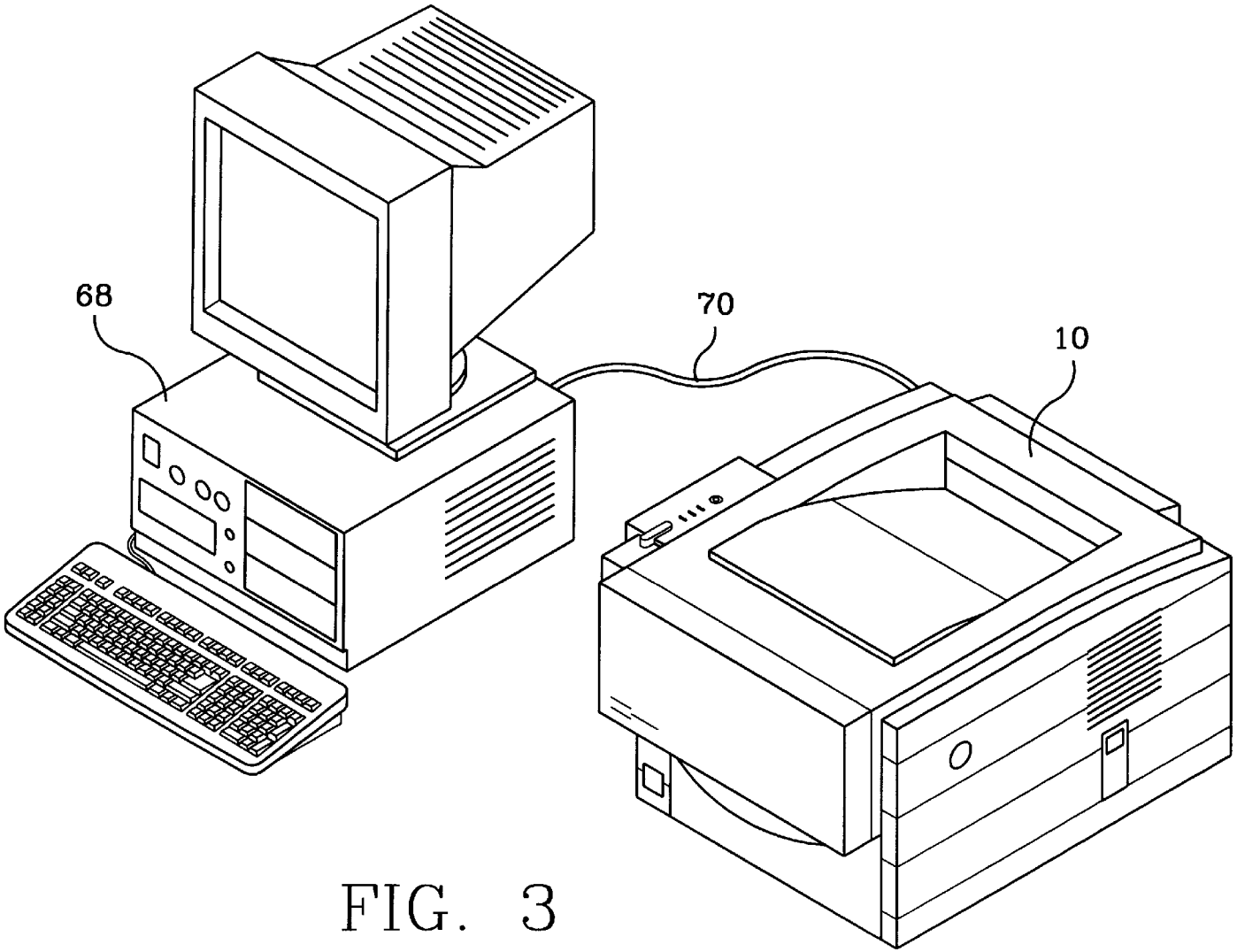
FIG. 3 is a perspective view of personal computer connected to a printer illustrating the remote generation of cleaning pages.

In one example of a software implementation, and referring to FIG. 3, a personal computer 68 is the host device connected to printer 10 through connector 70. Connector 62 represents generally any of the various connecting devices that enable communication between computer 68 and printer 10, including parallel, serial and network cable connections or telecommunication, infrared and radio frequency links. Computer 68 includes document generating software and its associated printer driver. Collectively, these define one of several possible source documents generators. The source document generator produces an electronic representation of the cleaning page to be printed and provides this data as an input to printer 10 at input port 12. The data input includes the desired cleaning pattern and instructions for duplex printing, which is transmitted to formatter 14 and on to printer controller 16 and print engine 18. The remote generation of cleaning pages afforded by this "software option" eliminates the need for user interaction with the printer and may be useful for ensuring optimal print quality in a network environment.

While the present invention has been shown and described with reference to the foregoing embodiments, other forms and details may be made thereto without departing from the spirit and scope of the invention as defined in the following claims.

What is claimed is:

1. A method for automatically cleaning a fuser in an image forming device, the method comprising:

applying a toner image cleaning pattern to a sheet of print media;

fusing the toner image to the sheet;

routing the sheet through a duplexer to invert the sheet; and routing the inverted sheet back through the fuser.

2. A method according to claim 1, further comprising initiating the steps of applying, fusing and routing from a control panel on the image forming device.

3. A method according to claim 1, further comprising initiating the steps of applying, fusing and routing from a location remote from the image forming device.

4. A method according to claim 1, further comprising initiating the steps of applying, fusing and routing automatically from within the image forming device.

5. A method according to claim 3, wherein the remote location is a host computer.

6. A method according to claim 3, wherein the remote location is a network print server.

7. A method according to claim 1, further comprising advising a user that the fuser cleaning is complete.

8. A method according to claim 1, further comprising instructing a user to discard the cleaning sheet.

9. An image forming device, comprising:

a print engine including a photoconductor, a fuser and a duplexer;

a printer controller operatively coupled to the print engine; and the printer controller having a microprocessor and related programmable memory configured to transmit electronic data to the print engine to apply a toner image cleaning pattern to a sheet of print media, fuse the toner image to the sheet, route the sheet through a duplexer to invert the sheet, and route the inverted sheet back through the fuser.

10. A device according to claim 9, further comprising a formatter, the printer controller operatively coupled between the formatter and the print engine, and the formatter having a microprocessor and related programmable memory configured to generate and transmit to the printer controller electronic data representing a desired cleaning pattern.

11. A device according to claim 10, wherein the formatter and the printer controller are discrete components of the image forming device.

12. A device according to claim 10, wherein the formatter and the printer controller form one integral component of the image forming device.

13. A method according to claim 9, wherein the printer controller is configured to automatically transmit the electronic data in response to a predetermined event.

14. A method according to claim 13, wherein the event is a first print job boundary after a predetermined number of pages have been printed.

15. A method according to claim 13, wherein the event is a first print job boundary after a user selected number of pages have been printed.

* * * * *